US005143524A

United States Patent [19]

Inculet et al.

[11] Patent Number: 5,143,524

[45] Date of Patent: Sep. 1, 1992

[54] ELECTROSTATIC PARTICLE FILTRATION

[75] Inventors: Ion I. Inculet, London, Canada; John R. Lackner, Westlake; James C. Murphy, Broadview Hts., both of Ohio

[73] Assignee: The Scott Fetzer Company, Westlake, Ohio

[21] Appl. No.: 481,854

[22] Filed: Feb. 20, 1990

[51] Int. Cl.[5] ..... B03C 3/00

[52] U.S. Cl. ..... 55/2; 55/123; 55/131; 55/139; 55/155

[58] Field of Search ..... 55/2, 154, 155, 131, 55/123, 139

[56] References Cited

U.S. PATENT DOCUMENTS

| | | | |
|---|---|---|---|
| 1,059,253 | 4/1913 | Wimbish | 55/151 |
| 2,080,242 | 5/1937 | Ward | 55/131 |
| 3,334,370 | 8/1967 | Boyd | 15/327 |
| 3,355,562 | 11/1967 | Boyd | 200/86.5 |
| 3,590,412 | 7/1971 | Gerbasi | 118/637 |
| 3,592,639 | 7/1971 | Chaplinski | 134/1 |
| 3,597,789 | 8/1971 | Boyd | 15/383 |
| 3,724,174 | 4/1973 | Walkenhorst | 55/123 |
| 3,739,522 | 6/1973 | Webster et al. | 55/123 |
| 3,930,815 | 1/1976 | Masuda | 55/131 |
| 4,058,936 | 11/1977 | Marton | 51/170 T |
| 4,155,727 | 5/1979 | Kaulig | 55/381 |
| 4,185,972 | 1/1980 | Nitta et al. | 55/155 |
| 4,198,061 | 4/1980 | Dunn | 274/47 |
| 4,213,224 | 7/1980 | Miller | 15/344 |
| 4,225,086 | 9/1980 | Sandell | 239/428 |
| 4,282,626 | 8/1981 | Schneider | 15/320 |
| 4,376,642 | 3/1983 | Verity | 55/105 |
| 4,588,537 | 5/1986 | Klaase et al. | 264/22 |
| 4,626,263 | 12/1986 | Inoue et al. | 55/155 |
| 4,652,282 | 3/1987 | Ohmori et al. | 55/155 |
| 4,665,581 | 5/1987 | Oberdorfer | 15/326 |
| 4,697,300 | 10/1987 | Warlop | 15/327 R |
| 4,715,078 | 12/1987 | Howard et al. | 15/4 |
| 4,715,085 | 12/1987 | Johanson | 15/339 |
| 4,715,086 | 12/1987 | Johanson et al. | 15/339 |
| 4,785,492 | 11/1988 | Gilime | 15/380 |
| 4,980,796 | 12/1990 | Huggins et al. | 55/123 |

FOREIGN PATENT DOCUMENTS

| | | | |
|---|---|---|---|
| 0332282 | 9/1989 | European Pat. Off. . | |
| 0345828 | 12/1989 | European Pat. Off. . | |
| 894154 | 10/1953 | Fed. Rep. of Germany . | |
| 2166206 | 5/1973 | Fed. Rep. of Germany . | |
| 1212584 | 2/1986 | U.S.S.R. | 55/131 |
| 334210 | 3/1931 | United Kingdom . | |
| 881975 | 11/1961 | United Kingdom . | |
| 1025064 | 4/1966 | United Kingdom . | |
| 1094832 | 12/1967 | United Kingdom . | |
| 1154604 | 6/1969 | United Kingdom . | |
| 1501927 | 2/1978 | United Kingdom . | |
| 1535635 | 12/1978 | United Kingdom . | |
| 2029259 | 5/1980 | United Kingdom . | |
| 2033248 | 5/1980 | United Kingdom . | |
| 2108377 | 5/1983 | United Kingdom . | |
| 2131320 | 6/1984 | United Kingdom . | |

OTHER PUBLICATIONS

European Patent Appln. No. 87103225.6, filed Mar. 6, 1987.

*Primary Examiner*—Bernard Nozick

*Attorney, Agent, or Firm*—Watts, Hoffmann, Fisher & Heinke Co.

[57] ABSTRACT

A vacuum cleaner is disclosed having an on-board electrostatic filtration device for removing ultra fine particles from the suction air stream which is discharged into the vacuum cleaner's dirt collection receptacle. The electrostatic filtration device includes a finely woven conductive mesh made from two electrically insulated sets of conductive filaments between which a low voltage electrical potential difference is applied. The polarity of the electrical potential difference is periodically reversed at low frequency to assist in maintaining filtering effectiveness notwithstanding the accumulation on the mesh of significant amounts of retained particulate matter. High permitivity material is incorporated between filaments to enhance electric fields in the mesh created by the electrical potential difference.

20 Claims, 3 Drawing Sheets

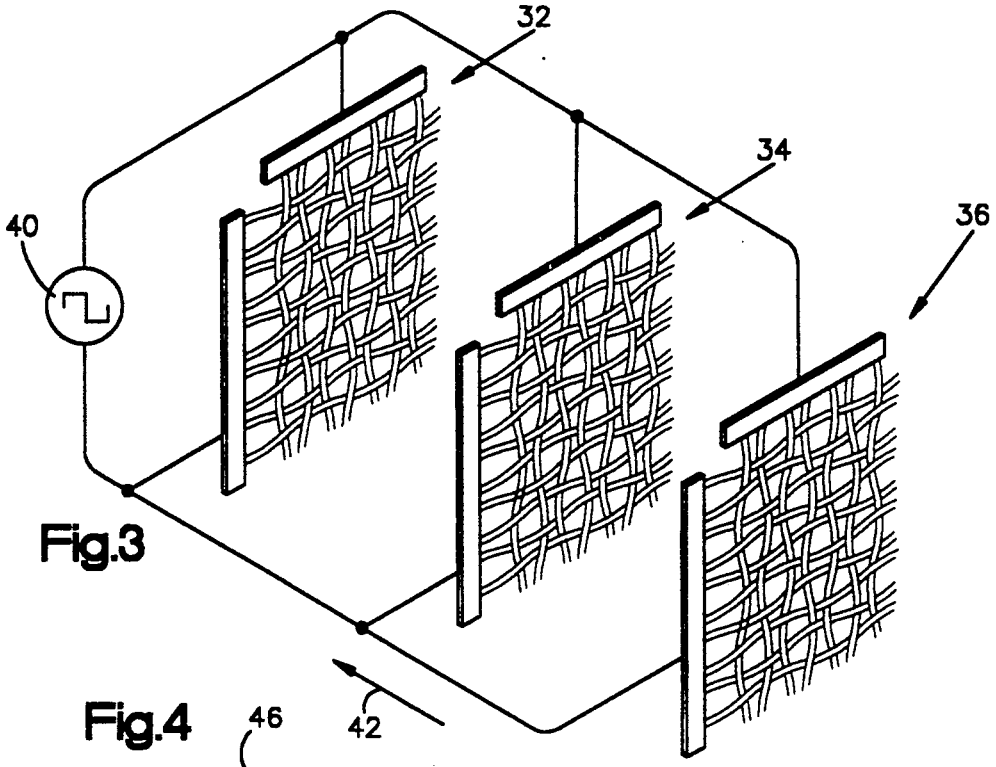
Fig.3
Fig.4
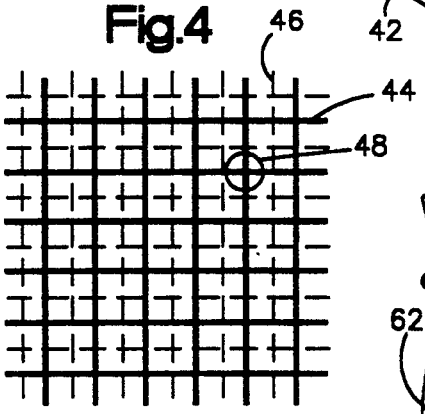
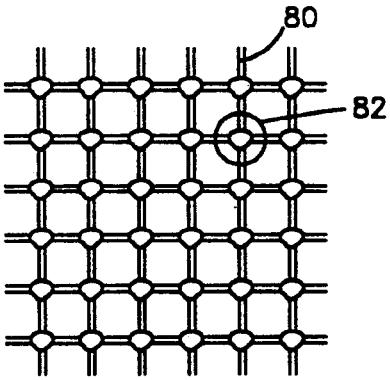
Fig.7
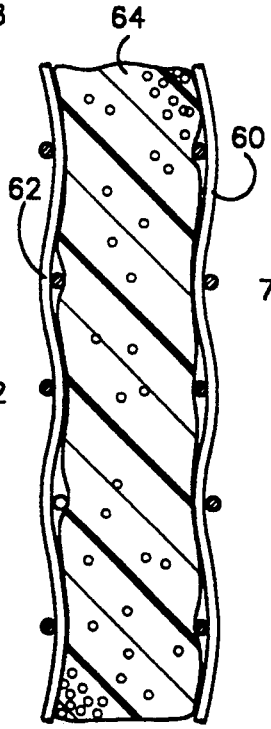
Fig.5
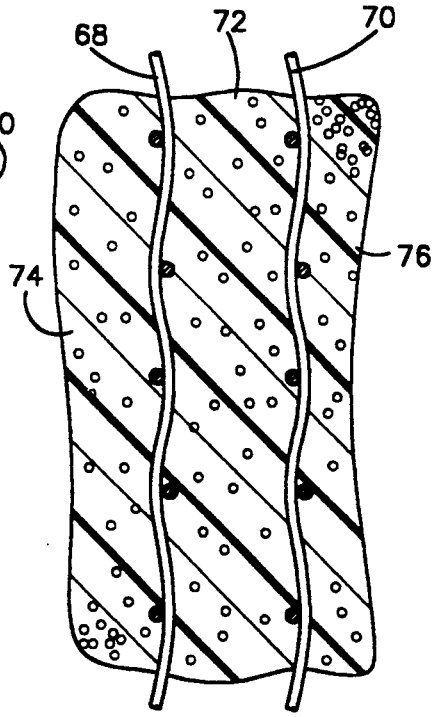
Fig.6

| +9V TO −9V SWITCH POTENTIOMETER TURNED FULLY CLOCKWISE | |
|---|---|
| SWITCH POSITION | TIME (SEC) |
| 1 | 1 |
| 2 | 2 |
| 3 | 4 |
| 4 | 8 |
| 5 | 16 |
| 6 | 32 |
| 7 | 64 |
| 8 | NOY USED |

| POTENTIOMETER TURNED FULLY COUNTERCLOCKWISE | |
|---|---|
| SWITCH POSITION | TIME (SEC) |
| 1 | 7 |
| 2 | 14 |
| 3 | 28 |
| 4 | 56 |
| 5 | 112 |
| 6 | 224 |
| 7 | 448 |
| 8 | NOY USED |

ELECTROSTATIC PARTICLE FILTRATION

TECHNICAL FIELD

This invention relates generally and is applicable to most forms of electrostatic filtration. It relates more particularly to an on-board electrostatic filter for trapping minute particles picked up by a vacuum cleaner and propelled into its dirt collector.

BACKGROUND ART

An important application of the present invention is in vacuum cleaners. Such machines include apparatus for applying suction to dislodge undesirable particulate matter from a surface to be cleaned, by generating a high velocity air flow. The suction apparatus includes structure for channelling the dirt-laden air into a narrow stream. A collection bag or other receptacle is mounted to receive the particle and air flow. A typical bag includes a jacket formed of air pervious material, such as paper and/or tightly woven fabric, to mechanically filter particulate matter, while allowing the filtered air to dissipate outwardly through the bag and back into the external environment.

Vacuum cleaners which rely solely on mechanical filtration, however, filter only particles of greater than a given size, while allowing smaller particles to pass through the filter and re-enter the external environment. This is because, in order to permit the air to pass freely out of the bag, the interstices in the paper or fabric, which permit air to pass through, cannot be too small. Otherwise, the suction air stream is inhibited, and air velocity becomes too low for good suction. While one could increase suction and air volume by use of more powerful electric motor drive systems, the use of inordinately large and heavy electric motors in a household appliance such a vacuum cleaner can become both impractical and uneconomical. The weight and cost of large motors make their use prohibitive in vacuum cleaners designed for household use.

The fine particles that pass through the bag and back into the external environment can include very small dust particles, contributing to odor and re-accumulation. Other particles escaping filtration are allergy-aggravating pollen and bacteria, as well as mites, which can be a health hazard.

One proposal to improve a vacuum cleaner's effectiveness in filtering very small particles has been to add on-board electrostatic filtration equipment, while still maintaining a reasonable pressure drop through the filter media and hence reducing the size and power of the suction motor system. Such equipment has included at least two elements between which an electrical potential difference is applied. The electrical potential difference generates an electric field between the elements. It also causes the elements to become electrically charged. The element to which voltage of a given polarity is applied attracts oppositely charged particles of dirt, as well as oppositely charged, naturally occurring ions, such as gas ions.

The elements are positioned in the particle-laden air stream. A charged element, as noted above, attracts oppositely charged particles passing along in the air stream. Moreover, even some neutrally charged particles are attracted to the element by a phenomenon known as dielectrophoresis.

It has also been proposed to augment such electrostatic filtration by provision of a so-called "corona" device in the air stream. A corona device produces an electrical space charge which is distributed generally throughout a region. Such space charge, if generated in the particle-laden air stream, pre-charges the particles. This imposition of charge on the particle increases the force attracting or repelling them to the electrically polarized filter element.

One problem with on-board vacuum cleaner electrostatic filters is the necessity for providing a relatively high electrical voltage on a substantially continuous basis while the machine is operating. This often requires large, heavy and expensive power supplies, sometimes including heavy batteries. Such equipment degrades portability and ease of machine operation.

A further proposal has been to place in the air stream a piece of electrically charged fleece.

Another type of device for electrostatic filtering incorporates what is known as "electret" material. Electret materials have low electrical conductivity and usually have dielectric properties as well. They also have the property of retaining charge polarization for a long time. Electret materials have been used as electrostatic filters in surgical masks.

The filter equipment described above has a further disadvantage. When a charged surface "loads up" with accumulated particles, the charge on the charged filter element can become neutralized or canceled, due to the opposite polarization of particles and ions attracted to its surfaces. This tends to cancel the generated electrical fields, hindering or totally disabling operation of the device.

An object of this invention is to provide electrostatic filtering apparatus and circuitry (1) whose effectiveness does not deteriorate as the amount of retained filtered material increases, (2) which is effective at low operating voltages, and (3) which is lightweight, relatively inexpensive and compact.

DISCLOSURE OF THE INVENTION

The disadvantages of the prior art are reduced or eliminated by the provision of a vacuum cleaner having a new and improved on-board electrostatic filtration system. The electrostatic filtration system includes a mesh finely woven of two sets of conductive filaments or fine wires which are electrically insulated one from another. A source of electrical potential is coupled to apply an electrical potential difference between the two sets of conductive filaments or wires. Circuitry is provided for repeatedly reversing the polarity of the electrical potential applied between the sets of conductive filaments or wires.

The mesh is located within the vacuum cleaner's dirt receptacle, which typically is a bag. The mesh has an expanse large enough to cover a substantial portion of the interior of the bag.

The reversal in polarity of the applied electrical potential difference assists in maintaining filtration effectiveness which would otherwise be degraded by the accumulation of a substantial layer of filtered particulate matter on the mesh, and by attraction to the mesh of oppositely charged neutrally occurring ions. When the voltage polarity is abruptly reversed, the resulting suddenly reversed charge polarity on the wire insulation surface adds directly to other charge already on the nearby particles and which is left over from the previous cycle. This restores, and actually increase, the strength of the electrical field produced by the electrical potential difference applied, to achieve better electrostatic filtering results.

In accordance with a more specific embodiment, the frequency of voltage polarity reversal is low, on the order of about one cycle per second or less. The low frequency allows for the desirable electrostatic phenomena to occur, while still providing for repeated polarity reversal to restore and magnify the filtering electric fields produced by the electrified mesh.

In accordance with a more specific embodiment, multiple stages of mesh are used. The stages are serially stacked in the air flow, and function together to filter the discharge air more thoroughly than a single mesh.

In accordance with other specific embodiments, high permitivity material is added to the meshes in order to increase the strength of the electric fields obtainable for a given voltage. The high permitivity material can be located between the meshes. Another location for high permitivity material is its local application between mesh wire intersections in a single mesh.

In accordance with another specific embodiment, a fibrous mechanical filter can be added in series with a mesh for enhanced filtration.

According to a specific feature, a suitable high permitivity material comprises aluminum oxide powder.

Another specific embodiment, applicable to a multistage construction, involves the staggered placement of successive meshes. Such staggered placement increases the density of charged wire distribution across the cross section of the air stream, without appreciably increasing resistance to the air flow.

These and other advantages of the embodiments of the present invention can be seen in more detail and readily understood by reference to the following detailed description, and to the drawings, in which:

BRIEF DESCRIPTION OF THE DRAWINGS

FIG. 3 is a detailed pictorial view illustrating a portion of the vacuum cleaner of FIG. 1 incorporating another embodiment of the present invention;

FIG. 4 shows an embodiment alternative to that of FIG. 3;

FIG. 5 is a detail elevational view illustrating a portion of the structure shown in FIG. 2 and incorporating an alternate embodiment of the present invention;

FIG. 6 is an elevational detail view illustrating a portion of the structure shown in FIG. 2 and incorporating another alternate embodiment of the present invention;

FIG. 7 is a detail showing of a portion of the structure shown in FIG. 2, showing another alternate embodiment of the invention;

BEST MODE FOR CARRYING OUT THE INVENTION

Figure 1:
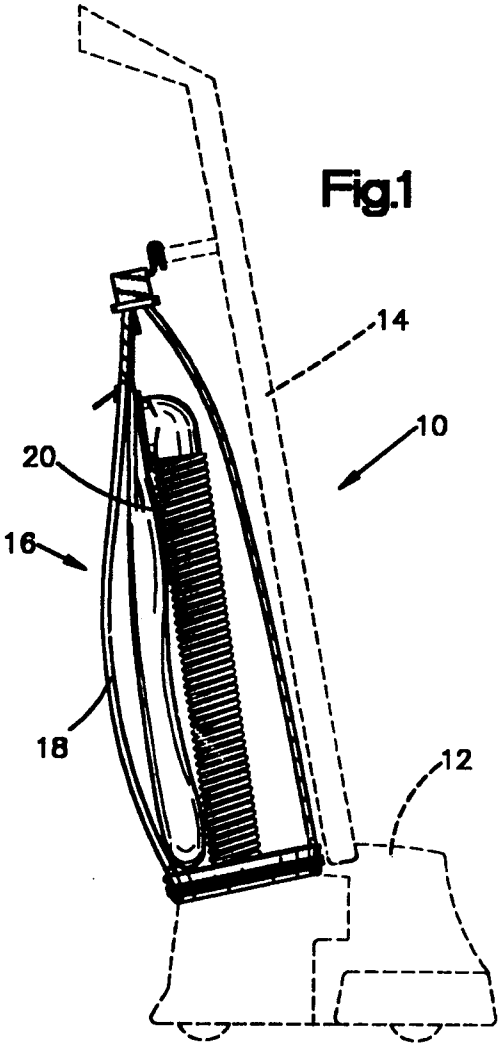
FIG. 1 is a pictorial side view partly broken away and partly in phantom, illustrating a vacuum cleaner incorporating an embodiment of the present invention.

FIG. 1 shows a vacuum cleaner 10 which incorporates the present inventive apparatus and circuitry for electrostatically filtering very fine particulate matter picked up by the vacuum cleaner. While the present invention is described in the environment of a vacuum cleaner, the invention is not limited to that particular application. Rather, the invention is believed applicable generally to electrostatic filtering in virtually any environment.

The vacuum cleaner 10 in which the present invention is incorporated is of otherwise known type. A vacuum cleaner suitably incorporating the present invention is a Kirby Model, manufactured by Kirby Division, The Scott-Fetzer Company, Cleveland, Ohio, U.S.A. The vacuum cleaner includes a housing 12 and a handle 14 pivotally mounted to the housing (both in phantom). The housing 12 encloses a known electric motor and blower combination (not shown). The blower/motor combination, when actuated, generates a high velocity air stream for providing suction, and ducting (also not shown) for applying the generated suction to a region below the underside of the housing 12. The suction so generated dislodges dirt and other particulate matter from a surface on which the housing rests. The air stream generated by the blower/motor combination thus becomes laden with the particulate matter.

The ducting structure within the housing defines a discharge opening (not shown) near the rear of the housing 12. The particle-laden air stream is discharged from the discharge opening into a collection receptacle generally indicated by the reference character 16.

The collection receptacle 16 comprises a flexible bag having an opening which is removably attachable to position the opening to receive the particle-laden air flow discharge. The collection bag 16 includes an air pervious outer jacket 18 made of finely woven fabric. The collection receptacle optionally further includes an inner air pervious and disposable filter paper liner.

The collection bag 16 of FIG. 1 is shown partially broken away to illustrate a multi-element structure, generally indicated by the reference character 20. This structure constitutes a portion of apparatus and circuitry comprising an electrostatic filtering unit according to the present invention.

Figure 2:
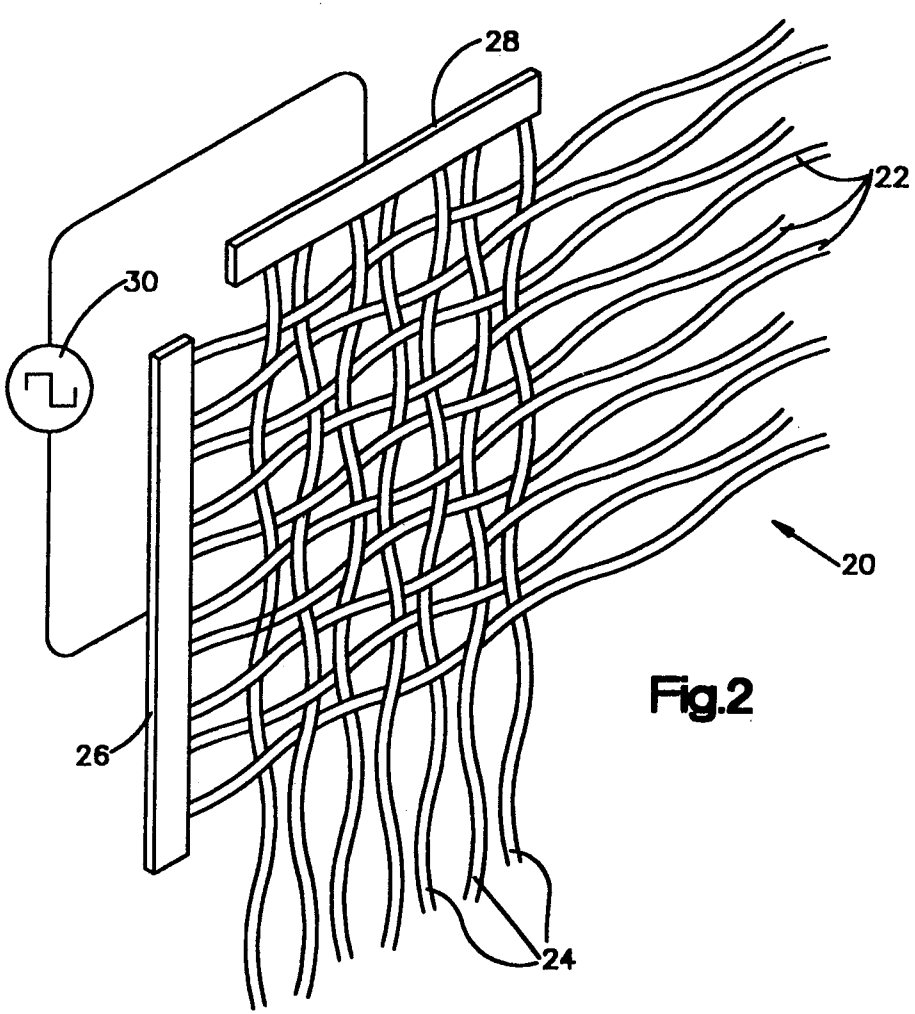
FIG. 2 is a pictorial detail view showing a portion of the vacuum cleaner of FIG. 1.

The structure 20 is illustrated in more detail in FIG. 2. The structure 20 comprises a fine electrically conductive wire mesh, or cloth.

The wire mesh 20 includes two sets of interlaced fine conductive filaments or wires. A first set of conductive wires extends generally horizontally as illustrated in FIG. 2. A second set of conductive wires extends generally vertically in FIG. 2. Representatives of the first set of wires are indicated collectively by reference character 22. Representatives of the second set of wires are denoted collectively by reference character 24.

Each of the individual wires of the sets 22, 24 are electrically insulated. Each of the wires making up the mesh comprises a copper wire approximately 0.002 inches in diameter and covered by a thin insulating material, in this case a coating of enamel.

Alternately, each of the wires of the mesh comprises an aluminum wire of approximately 0.002 inches in diameter. Where aluminum is used, aluminum oxide which naturally forms in the presence of air on the outside surface of the wires provides the needed insulation.

In place of metallic wires, the mesh 20 can optionally comprise filaments of known types of conductive plastic material.

Each of the first set of conductors 22 is conductively coupled at one end, by gold or nickel contacts, to a common busbar 26. Each of the second set of conductive wires 24 is conductively coupled at one end by similar contacts, to a busbar 28.

The first and second sets of conductors 22, 24 correspond, in Weaver's terminology, to the "warp" and "weft" of cloth.

A source 30 of alternating electrical voltage is coupled between the busbars 26, 28. The source 30 applies a square wave having peak voltage of approximately 9 volts positive and negative, to the busbar 28. The busbar 26 is substantially grounded.

The source 30 can be constructed from the combination of a 9 volt battery and a polarity reversing switch, circuitry well within the ordinary skill in the art, given the present disclosure.

The battery can be disposable. Alternately, the battery can be of the rechargeable variety. In such an instance, the recharging of the battery can be accomplished by known apparatus and circuitry coupled to draw power from the main power operating system of the vacuum cleaner.

Tests have shown that both lower and higher voltages can be effective. Voltages as low as one half volt can be useful in some systems. Voltages up to 200 volts are also feasible, where safe materials are provided.

The ends of the wires 22 comprising the first set opposite the busbar 26, terminate in electrical insulation, and are not conductively coupled together. The ends of the wires 24 of the second set opposite the busbar 28 also terminate in electrical insulation.

This configuration renders the electrical source 30, combined with the wire sets 22, 24, a primarily capacitive open circuit, rather than a resistive circuit. The circuit is not conductively closed. As such, the current flow in the circuit, and the power consumed, is extremely small. Such low power requirements make it possible for the 9 volt battery to be very small and lightweight. This contributes to the portability, simplicity, and economy of the vacuum cleaner 10 with which the electrostatic filter is associated.

Tests have shown that a suitable frequency of electric polarity reversal, or alternation, for improving filtration effectiveness, is on the order of one cycle per second, or lower, down to about one cycle every 20 minutes. It is believed, however, that selection of the optimum frequency of operation depends on other parameters of the system, such as wire diameter and the size of the interstices of the mesh, along with air flow velocity, voltage, humidity, etc.

A low frequency of reversal, however, is of value in all instances. Low frequency allows time between reversals for the circuit to reach a steady state and for beneficial electrostatic phenomena, described in more detail below, to occur.

Other tests have shown that a mesh having approximately 200 wires per inch can accomplish effective electrostatic filtration. This amounts to a center to spacing of the wires of approximately 0.003 center inches.

For most of the time, (between reversals) a constant electrical potential difference of constant polarity is applied between the wire sets 22, 24.

When an electrical potential difference of constant polarity is provided between the wire sets, an electric field of constant polarity is generated in the interstices between wires of the different respective sets.

This electric field can be quite strong indeed.

With the mesh as above described, even a relatively low voltage, i.e., about 9 volts, can generate electric fields between respective sets of wires on the order of 5,000 to about 100,000 volts per meter.

These strong electric fields cause the wire sets to attract fine airborne particulate matter in the vicinity of the mesh. When a potential difference is applied between the wire sets, the surfaces of the wire insulation become electrically charged. When a positive voltage is applied to a wire, its insulation surface tends to become positively charged. When a negative voltage is applied, the insulation surface tends to become negatively charged.

These charges perform two beneficial functions. First, they attract all particulate matter (and naturally occurring atmospheric ions) having a net charge which is opposite to the charge appearing on the wire insulation surface. Additionally, they attract, by electrophoresis, even particles having a net neutral, or zero, electrical charge.

The mesh 20 is located within the collection bag 16, near the inner surface of the outer jacket portion 18. The mesh 20 is of sufficient lateral expanse to enable it to cover a substantial portion of the interior of the bag jacket. Thus, the mesh 20 intercepts the particle-laden air stream discharged into the bag. When the electrical source 30 is actuated, applying the electrical potential difference between the two sets of wires 22, 24, the electric fields so generated cause the mesh to attract and retain dirt, atmospheric ions and other very fine particles borne by the air stream passing through the mesh.

Filtered particles include allergy-causing pollen, which can be very small, and can even include bacteria, thus removing from the air a substantial amount of these health-hazardous organisms.

The alternation, or reversal, of the polarity of the voltage applied between the first and second sets of wires of the mesh 20 helps maintain filtration performance even as the mesh begins to "load up" with accumulated trapped particulate matter, and with atmospheric ions. If the polarity of the voltage were always constant, accumulated particles and ions on the wires would inhibit further attraction and retention of other particles.

When particulate matter and ions accumulate on the charged wire insulation surfaces, the accumulated material reduces the electric fields generated between the sets of wires in the mesh. The charge of the accumulated particles, and of attracted naturally occurring ions, tends to cancel the electric fields produced between the wires. This reduces filtration effectiveness.

An important aspect of solving this problem is the repeated reversal of the polarity of electrical voltage between the wire sets constituting the mesh. Advantages of this polarity reversing technique, as explained below, result in part from residual charge which remains on the wire outer insulation surface from the previous cycle of voltage polarity. These advantages include both restoration and strengthening of the filtering electric fields following polarity reversal.

For explanation, consider the situation where the voltage polarity is positive, such that a given wire insulation surfaces bears a positive surface charge. Particle and ionic charge facing the wire insulation will be negative. If the voltage polarity applied to the wire is now abruptly reversed (made negative), the amount of negative charge at and adjacent the wire insulation surface will substantially double. This occurs because the negative residual charge on the retained ions and particles, (left over from when the wire was positively charged)

plus negative surface charge newly appearing on the wire insulation surface after the reversal, will jointly add to restore, and substantially double, the electric field.

Due to the somewhat insulative property of the adhering particles, the residual charge will decline only gradually, not all at one, after polarity reversal. Over time, however, the residual charge on the particles will decay. This is mainly due to oppositely charged particles and ions which are attracted to the wire insulation surface after its polarity goes negative.

The charge reversal will cause some of the particles to move and adhere to the wires of the opposite set in the mesh.

FIG. 3 illustrates an embodiment of the present invention incorporating multiple, serially arranged conductive wire meshes 32, 34, 36. Each of the meshes, 32, 34, 36, is the same as the mesh 20 illustrated in FIG. 2 and described in connection with that Figure. An alternating voltage source 40 is connected in parallel to the respective wire sets of each of the meshes 32, 34, 36. The circuitry and apparatus constituting the source 40 are the same as in the voltage source 30 illustrated in FIG. 2.

The conductive wire meshes 32, 34, 36 are arranged serially with respect to air flow within the collection bag 16. For the purposes of FIG. 3, the direction of air flow is indicated by an arrow 42. The advantage of the multiple mesh embodiment of FIG. 3 is that the three meshes 32, 34, 36, acting serially in conjunction with one another, can normally be expected to attract and retain more of the fine particulate matter present in the air stream.

Optionally, a layer of fibrous mechanical filter material can be added between the mesh stages.

While FIG. 3 illustrates the alternating polarity voltage source 40 as a single source connected in parallel to each of the meshes 32, 34, 36, it is to be understood that the source 40, with its parallel connections to each of the meshes, could be replaced by an individual similar source each dedicated to a single one of the meshes 32, 34, 36. The use of individual sources for each of the meshes of FIG. 3 enables the polarity reversals on the three meshes to take place spaced in time from one another, rather than in unison, as in the FIG. 3 embodiment where the parallel coupled source 40 is used. Individual sources each coupled to a different mesh enable a sequential polarity reversal.

FIG. 4 illustrates another embodiment of the present invention employing multiple meshes in a staggered configuration. FIG. 4 illustrates two serially arranged meshes 44, 46. The mesh 44 is located upstream, relative to the air flow, with respect to the mesh 46. FIG. 4 illustrates the mesh 44 as diagonally staggered with respect to the mesh 46. The amount of this diagonal staggering is such that the intersections of wires, such as 48, in the mesh 44 are located approximately in the center of the interstices of the mesh 46. This staggering increases the density of charged wires disposed in the air stream, without substantially increasing resistance to the air stream.

Other means can be used to enhance operation of the mesh filters. Tests have shown that filtration performance can be improved by the addition of a high permitivity material in, or between, the woven meshes. A suitable material has been found to comprise aluminum oxide grit.

FIG. 5, for example, shows a pair of vertically extending wires 60, 62. FIG. 5 is a view looking at two meshes edgewise. FIG. 5 is simplified for purposes of clarity, with the wires 60, 62 being isolated single vertical wires of adjacent meshes.

Between the wires 60, 62 is a portion 64 of high permitivity material. The high permitivity material substantially fills the space between the adjacent meshes.

The high permitivity material 64 comprises particles of aluminum oxide of the order of microns in diameter, held together, if need be, by a suitable insulative binder which can be provided by one of ordinary skill in the art. The presence of this fine powder material between the meshes and in the vicinity of the conductive wires enhances the magnitude of the electric field which can be achieved between wires for a given voltage difference.

Optionally, the high permitivity material, such as aluminum oxide, can be supported on a nylon mesh substraight, or can be impregnated into fused pellets made of the material commonly known by the trademark "TEFLON".

FIG. 6 illustrates a similar pair of wires 68, 70, but in this embodiment the high permitivity material is present not only between the meshes, as at reference character 72, but also extends through the meshes to the exterior, such as shown at reference characters 74, 76.

FIG. 7 illustrates still another manner of employing the high permitivity material. FIG. 7 illustrates a single mesh 80. The high permitivity material is applied locally between each intersection of a horizontal and vertical wire, as shown for example at reference character 82.

Optionally, the electrostatic filtration unit 20 can be supplemented by inclusion in the vacuum cleaner of a corona discharge device in the dirty air stream. The corona discharge device imparts an electrical charge to dirt and other particulate matter passing through its corona. This additional charge renders the particles more susceptible of capture by the electrostatic filtration unit 20.

Another possible option is the use of a triboelectric device. Such a device, which can comprise tubes made of a plastic material known by the trademark TEFLON, can also impart an electrical charge to particles passing in the vicinity.

As mentioned above, the alternating voltage source, such as at reference character 30 in FIG. 2 and 40 in FIG. 3, can comprise a 9 volt small lightweight battery in series with a polarity reversing switch.

It is believed that a suitable polarity reversing switch for placement in series with a low voltage battery can readily be designed by one of ordinary skill in the art.

Figures 8, 9:
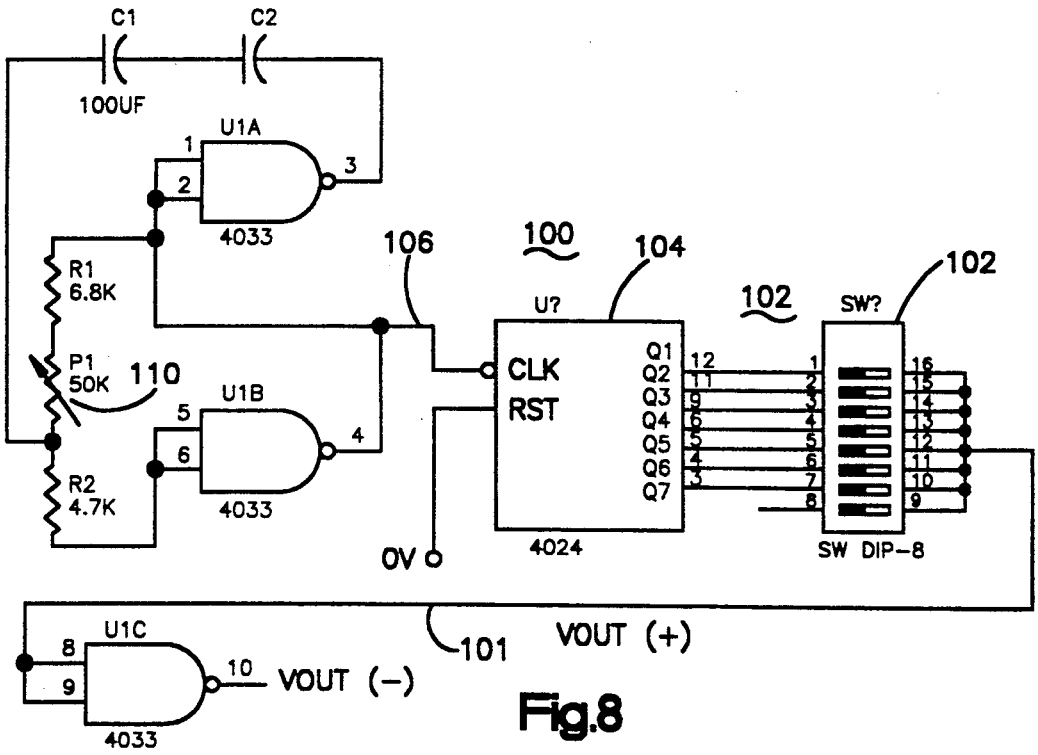
FIG. 8 is a schematic drawing of a circuit which constitutes a portion of an embodiment of the present invention.
FIG. 9 is a tabular rendition describing an aspect of the operation of the present invention.

FIG. 8 illustrates in schematic form a circuit for providing a low voltage alternating polarity signal suitable for use in the present device. The circuit is generally indicated by the reference character 100. The circuit produces a low voltage alternating polarity output at a lead 101. The output 101 is fed by the output of an 8 position dip switch 102. The inputs to the dip switch 102 are provided by a seven stage clocking circuit 104. In operation, only one of the switching elements of the dip switch 102 is set to provide a conductive path from one of the inputs of the dip switch to a corresponding one of its outputs. The dip switch is used to divide the output of the clocking circuit 104 according to the respective significant bits of the outputs of the clock. The output appearing at the lead 101 has a frequency of reversal which is a function of which one of the output bits of the clock is selected by the setting of the dip switch 102. The higher the significance of the clock bit output selected, the lower is the frequency of polarity reversal of that output.

The clocking signal is supplied to the clocking circuit 104 at a lead 106. The frequency of the clocking signal can be adjusted by adjusting the setting of a potentiometer 110. This operation is described in more detail in connection with FIG. 9.

FIG. 9 is a tabular rendition illustrating the functioning of the switching circuit 100. The upper table of FIG. 9 correlates the selected position of the dip switch 102 with the amount of time elapsing between successive reversals of polarity of the voltage applied to the meshes. As can be seen, the amount of time between successive polarity reversals can be selected to vary in increments between 1 second and 64 seconds. This corresponds to a frequency of alternation of between 30 cycles per minute and about ½ cycle per minute.

Further adjustment of switching frequency can be obtained by adjusting the potentiometer 110 in the switching circuit 100. The upper table of FIG. 9, described above, corresponds to the switching times which are available with the potentiometer turned to one extreme position. The table constituting the bottom portion of FIG. 9 gives the analogous switching times with the potentiometer in its opposite extreme position. As can be seen from the bottom table, with the potentiometer in its opposite position, switching times range between about 7 seconds and 448 seconds.

Accordingly, the switching frequency can be adjusted to a virtual infinity of values between one switching per second and one switching per 448 seconds.

While the present invention has been described in particularity, it is to be understood that those of ordinary skill in the art may make certain additions or modifications to, or deletions from, the specific features of the embodiments described herein, without departing from the spirit or the scope of the invention, as described in the appended claims.

We claim:

1. A vacuum cleaner comprising:

a) apparatus for producing an air stream for dislodging and carrying particulate matter from a surface to be cleaned;

b) structure for constricting said air stream along a defined flow path;

c) a mesh comprising two sets of electrically conductive and electrically insulated wires, said sets being insulated one from the other and being insulated one from the other and being positioned to intercept the particulate matter as it is carried along said flow path;

d) electrically isolated circuitry for applying an electrical potential difference between said sets of wires of said conductive mesh and, d) circuitry for repeatedly changing from time to time said applied electrical potential difference.

2. The vacuum cleaner of claim 1, wherein:

said circuitry for changing said electrical potential difference comprises circuitry for reversing the polarity of said electrical potential difference.

3. The vacuum cleaner of claim 1, wherein:

said circuitry for changing said electrical potential difference comprises circuitry for periodically effecting said change.

4. The vacuum cleaner of claim 1, wherein:

said circuitry for changing said electrical potential difference comprises circuitry for reversing the polarity of said potential difference periodically no more frequently than about one time per second.

5. A vacuum cleaner comprising:

a) apparatus and structure for producing a suction air stream for dislodging and carrying particulate matter from a surface to be cleaned and for delivering said air stream carrying said particulate matter to a discharge location;

b) a collection bag positionable near said discharge location to accept a discharge of said air stream carrying said particulate matter, said collection bag comprising:

i) an outer cover;

ii) two sets of relatively fine and electrically insulated wires, the sets forming a conductive mesh and being electrically insulated one from another;

iii) circuitry for applying an electrical potential difference between said two sets of wires; and c) electrically insulated circuitry coupled to said electrical potential application circuitry for alternating the polarity of said electrical potential difference at a frequency not to exceed about three cycled per minute.

6. The vacuum cleaner of claim 5, wherein said circuitry for applying an electrical potential difference comprises circuitry for applying electrical potential difference of less than about 10 volts.

7. The vacuum cleaner of claim 5, wherein said wires comprise thinly insulated copper wire.

8. The vacuum cleaner of claim 7, wherein said wire comprises copper and has a diameter of approximately 0.002 inches.

9. The vacuum cleaner of claim 5, wherein said wire comprise aluminum.

10. The vacuum cleaner of claim 9, wherein said wires have a diameter of approximately 0.002 inches.

11. A vacuum cleaner comprising:

a) suction air stream producing apparatus for dislodging and picking up particulate matter from a surface to be cleaned and for discharging said air stream;

b) a collection bag positionable to accept a discharge of said particulate laden air stream, said collection bag comprising:

i) an outer cover;

ii) two sets of relatively fine electrically insulated and conductive wires, the sets being electrically insulated one from another and configured together to form a mesh;

iii) circuitry including insulation for applying an electrical potential difference between said two sets of wires; and c) circuitry coupled to said electrical potential application circuitry for alternating the polarity of said electrical potential difference at a frequency not to exceed about one cycle per second.

12. The vacuum cleaner of claim 11, wherein said electrical potential and the size of the interstices of said mesh are chosen such that said electrical potential difference produces an electrical field in the vicinity of said mesh having a magnitude in the range of 5,000 to 100,000 volts per meter.

13. The vacuum cleaner of claim 11, wherein said mesh defines substantially square interstices having dimensions of approximately 0.003 inches on a side.

14. A vacuum cleaner comprising:

a) suction air stream for producing apparatus for dislodging particulate matter from a surface to be cleaned and for propelling said dislodged particulate matter along a path by use of the air stream;

b) a collection bag positionable to intercept particulate matter moving along said path and into said bag, said collection bag comprising:

i) two sets of elongated flexible electrically insulated and conductive members, each set being electrically insulated one from the other, the two sets together forming a mesh, and circuitry including insulation for applying an alternating electrical potential between said sets, said alternation being at a frequency of no greater than about one cycle per second.

15. A method of filtering particulate matter from an air stream, said method comprising the steps of:

a) filtering said air stream through a multi-element conductive mesh including two sets of conductive electrically insulated filaments, said sets being woven together but electrically insulated one from the other;

b) applying an electrical potential difference between said filament sets, and c) repeatedly reversing the polarity of said applied electrical potential difference.

16. In a vacuum cleaner including structure defining a suction inlet, an outlet, and an air stream path therebetween, and power suction source apparatus for producing an air stream between said inlet and said outlet, the improvement comprising:

a filter positioned to intercept air which exits from said outlet, said filter comprising:

i) a woven mesh including two sets of electrically conductive filaments, said conductive filaments of each set bearing electrically insulating material thereon, the conductive filaments of one set being substantially perpendicular to the conductive filaments of the other set, and ii) insulated circuitry for applying an electrical potential difference between filaments of said two sets.

17. The improvement of claim 16 wherein the filaments of each set are connected together and are electrically insulated from the filaments of the other set.

18. The improvement of claim 16, further comprising:

a) said circuitry for potential application comprising a low-voltage battery; and b) a polarity reversing switch between said battery and at least one of said sets.

19. A filter comprising:

a) electrically conductive filaments, said filaments being electrically insulated from one another at least in part by solid electrically insulating material;

b) circuitry for applying an electrical potential difference between said filaments to create an electrical field sufficiently strong to attract dust particles for capture on said filaments;

c) said filaments being arranged to form a mesh wherein an insulated filament of one electrical potential substantially touches an insulated filament of another electrical potential; and, d) means for reversing the polarity of said applied electrical potential difference.

20. An electrostatic gas filter comprising:

a) a first electrically conductive filament bearing electrically insulating material;

b) a second electrically conductive filament also bearing electrically insulating material, said second filament being arranged to cross said first filament at substantially a right angle, the electrically insulating material of said first and second filaments substantially touching at the location of said crossing, and c) circuitry coupled between said first and second filaments for maintaining a predetermined electrical potential difference between said conductive filaments.

* * * * *